United States Patent [19]

Rose et al.

[11] 4,357,408

[45] Nov. 2, 1982

[54] ACIDIC ADHESIVE COMPOSITIONS AND SELF-PROCESSING PHOTOGRAPHIC PRODUCTS CONTAINING SAME

[75] Inventors: Robert R. Rose, Spencerport; Carl H. Eldredge, Rushville, both of N.Y.

[73] Assignee: Eastman Kodak Company, Rochester, N.Y.

[21] Appl. No.: 208,746

[22] Filed: Nov. 20, 1980

[51] Int. Cl.[3] ..... G03C 1/76; G03C 1/48

[52] U.S. Cl. ..... 430/207; 430/215; 430/216; 430/524; 428/480

[58] Field of Search ..... 156/327, 332; 430/207, 430/216, 215, 219, 220, 524

[56] References Cited

U.S. PATENT DOCUMENTS

| | | | |
|---|---|---|---|
| 2,859,200 | 11/1958 | Lappala . | |
| 3,256,090 | 6/1966 | Booth . | |
| 3,362,819 | 1/1968 | Land . | |
| 3,511,659 | 5/1970 | Dennis et al. . | |
| 4,009,029 | 2/1977 | Hammond et al. . | |
| 4,097,282 | 6/1978 | Noonan et al. . | |
| 4,113,493 | 9/1978 | Sandhu et al. . | |
| 4,201,578 | 5/1980 | Abbott . | |
| 4,246,333 | 1/1981 | Fuseya et al. | 430/219 |
| 4,292,390 | 9/1981 | Katoh | 430/207 |

OTHER PUBLICATIONS

Research Disclosure, publication 19146, Mar. 1980.
Research Disclosure, publication 13525, Jul. 1975.

*Primary Examiner*—John E. Kittle
*Assistant Examiner*—John L. Goodrow
*Attorney, Agent, or Firm*—J. L. Tucker

[57] ABSTRACT

Adhesive compositions are disclosed which are particularly useful as mask adhesives in instant photographic products. These adhesives provide high strength permanent bonds while greatly improving border quality around image areas after imagewise exposure and development. These adhesive compositions comprise a polymeric acidic component having at least 3 milliequivalents of acid per gram of polymer, and a substantially immobile, blocked photographic development restrainer or a substantially immobile, blocked competing photographic developer.

14 Claims, 4 Drawing Figures

ACIDIC ADHESIVE COMPOSITIONS AND SELF-PROCESSING PHOTOGRAPHIC PRODUCTS CONTAINING SAME

RELATED APPLICATION

U.S. Ser. No. 208,747, entitled SULFO-CONTAINING ADHESIVE COMPOSITIONS AND SELF-PROCESSING PHOTOGRAPHIC PRODUCTS CONTAINING SAME of Wayne A. Bowman filed concurrently herewith.

FIELD OF THE INVENTION

This invention relates to acidic adhesive compositions which are particularly useful in the image-recording field. In particular, it relates to mask adhesive compositions which provide high strength bonds in self-processing film units while greatly improving border quality around image areas. This invention also relates to image-recording elements and self-processing film units containing such adhesive compositions.

BACKGROUND OF THE INVENTION

Self-processing photographic products are well known. These products are generally referred to in the photographic art as diffusion transfer, image transfer or instant photographic film units.

In some of these units, an image-receiving layer exhibits a viewable image which can be separated from the image-recording layers after processing. In others, the image-receiving layer can remain permanently attached and integral with the image-recording layer and layers ancillary thereto when a transparent support is employed on the viewing side of the unit. After exposure of the film unit, an alkaline processing composition permeates the various layers to initiate development of the exposed image-recording layers. This processing composition can be introduced from outside the film unit or from a container or rupturable pouch associated with the film unit. In most instances, conventional darkroom processes and after-treatments, such as washing and stabilization are not needed to provide an acceptable image since the film unit is fully self processing.

Usually a self-processing photographic film unit has a thin framing means called a mask. This mask provides a border around an aperture which is adapted to receive the alkaline processing composition. The border also defines an image, or picture area. Typically the mask is located between and around the edges of two components of the film unit (e.g. cover sheet and photosensitive element) to provide a space or cavity between the components for the processing composition. The edge of the mask around the aperture restricts contact of the processing composition to the image area and confines the resulting image to such image area.

The mask is typically bonded to layers or components above and below it with various adhesives. For instance, U.S. Pat. No. 3,256,090 (issued June 14, 1966 to Booth), describes the use of encapsulated, low-strength adhesives to temporarily bond the mask to an image-receiving layer. The described adhesives are either pressure-sensitive, solvent-responsive, chemically-reactive or moisture-releasable adhesives. Other low-strength mask adhesives used to provide temporary bonds are described in U.S. Pat. No. 3,511,659 (issued May 12, 1970 to Dennis, Jr. et al). Those adhesives are mixtures of a vinyl pyrrolidone resin with a copolymer of vinyl acetate (80–90%, by weight) and an acidic monomer (5–20%, by weight). They are degradable by an alkaline processing composition.

Certain acidic polyester mask adhesives which provide permanent bonds in film units are described in U.S. Pat. No. 4,097,282 (issued June 27, 1978 to Noonan et al). Non-acidic polyester mask adhesives are described in U.S. Pat. No. 4,113,493 (issued Sept. 12, 1978 to Sandhu et al).

It has been the aim of workers in the photographic art for a long time to improve border quality in self-processing film units. Border quality denotes relative freedom from visible imperfections in the border around the aperture. Such imperfections include lines, spots, stains and dye deposits. However, these workers have had limited success in improving border quality. What may remove one imperfection may amplify another. The addition of various materials to various layers of the film unit to reduce imperfections is not always possible because such materials may cause sensitometric problems. Some imperfections are caused by manufacturing procedures which cannot be adequately modified to remove the imperfections.

One imperfection in the borders of self-processing film units is known as "border bleed." This imperfection causes the border to appear colored (e.g. cyan) instead of white and to blend into the image area. It is believed that border bleed results from the lateral migration of color-forming dyes or dye-providing materials (e.g. dye releasers) from the image area into the border during or after processing of image-recording layers. Such migration is accelerated when the film unit is subjected to elevated temperatures (e.g. 30°–60° C.) or high humidity after processing for extended periods of time.

Another imperfection observed in some film units after processing has begun is known as "dark edge line." This imperfection is a single or series of parallel dark lines, continuous or segmented, in the border at the edge of the image area. Dark edge line apparently forms in the following way. When alkaline processing composition is introduced into the image area, some of it moves laterally in the image-recording layers into the border "under" the mask. Dyes are caused to be released by the composition as it moves into the border. These dyes diffuse to the image-receiving layer and form objectionable darkened deposits (e.g. dark lines) in the border at the edge of the image area.

Dark edge line is intensified by the presence of air (in the form of "pockets" or "bubbles") which can occur at the border-image area interface. Oxygen within the bubbles causes dye to be released. This dye diffuses to the image-receiving layer and forms dye deposits. The aforementioned air pockets or bubbles can result from nucleation of bubbles at the mask-mask adhesive interface, or from voids in the adhesive. Bubble nucleation and voids can result from nonuniform sealing between mask and image-recording layers which often occurs during conventional manufacturing operations. Air bubbles can also result when the manufactured film units are subjected to stress in handling, shipping and use (e.g. twisting, bending, etc.). Such stressful conditions are very difficult to monitor and control, especially after the film units are in the hands of consumers.

The dark edge line imperfection becomes more pronounced when development is allowed to or necessarily proceeds for relatively longer periods of time (e.g. in the winter time or in colder climates). Yet such long development times may be desirable or necessary in certain situations with certain image-recording materials.

Some reduction in border bleed has been achieved by adding certain acidic terpolymers to gelatin interlayers or titanium dioxide reflective layers of self-processing photographic film units, as described in *Research Disclosure,* publication 19146, March, 1980 (published by Industrial Opportunities, Ltd., Homewell, Havant Hampshire PO9 1EF United Kingdom). However, this reference fails to teach or suggest how overall border quality can be improved by simultaneously and significantly reducing both border bleed and dark edge line imperfections. Moreover, it has been discovered that placement of the described terpolymers in interlayers or reflective layers may undesirably lengthen access time, i.e. the time required for image formation.

From the foregoing discussion, it is clear that there is a significant problem with imperfections in the borders of image-recording materials (e.g. self-processing film units). An improvement in border quality, particularly with regard to border bleed and dark edge line, would enhance the aesthetic qualities of processed film units (i.e. finished prints) while permitting extended development or storage time of unprocessed film units, if desired.

SUMMARY OF THE INVENTION

The present invention provides image-recording materials, i.e. photographic elements and self-processing photographic film units, which exhibit excellent border quality. This improved border quality is achieved by the use of a new mask adhesive composition which simultaneously provides high strength permanent bonds.

In one aspect, this invention provides an adhesive composition which is useful as a mask adhesive in self-processing photographic products. This composition comprises a polymeric acidic component having at least three milliequivalents of acid per gram of such component, and a substantially immobile, blocked photographic development restrainer or a substantially immobile, blocked competing photographic developer.

In another aspect, this invention provides an image-recording element which exhibits excellent border quality. This element comprises a support, a plurality of layers, including an image-recording layer having an image area adapted to be processed by an alkaline processing composition, and a mask. This mask provides an aperture which is adapted to receive the alkaline processing composition and a border which defines the image area. The mask is permanently bonded to the image-recording layer by the high strength acidic adhesive composition described hereinbefore which is adapted to neutralize the alkaline processing composition in the border. This adhesive composition is disposed within the border and is subject to contact with the alkaline processing composition.

In still another aspect, this invention provides a self-processing film unit which exhibits excellent border quality. This film unit comprises a support, a plurality of layers, including an image-recording layer having an image area adapted to be processed by an alkaline processing composition and an image-receiving layer, and a mask. This mask provides an aperture which is adapted to receive the alkaline processing composition and a border which defines the image area. The mask is permanently bonded to the image-recording layer by the high strength acidic adhesive composition described hereinbefore which is adapted to neutralize the alkaline processing composition in the border. This adhesive composition is disposed within the border and is subject to contact with the alkaline processing composition.

Border quality in self-processing photographic products is greatly improved by using the adhesive compositions of this invention as mask adhesives. Border bleed and dark edge lines, in particular, are significantly reduced by these mask adhesives. These photographic advantages are provided by these mask adhesive compositions without sacrificing the high strength permanent bonds necessary to adhere the mask to other layers. For certain embodiments described in detail below, these high strength bonds are provided over a wide range of temperature conditions used during the sealing operation of manufacture.

DETAILED DESCRIPTION OF THE INVENTION

Figure 1:
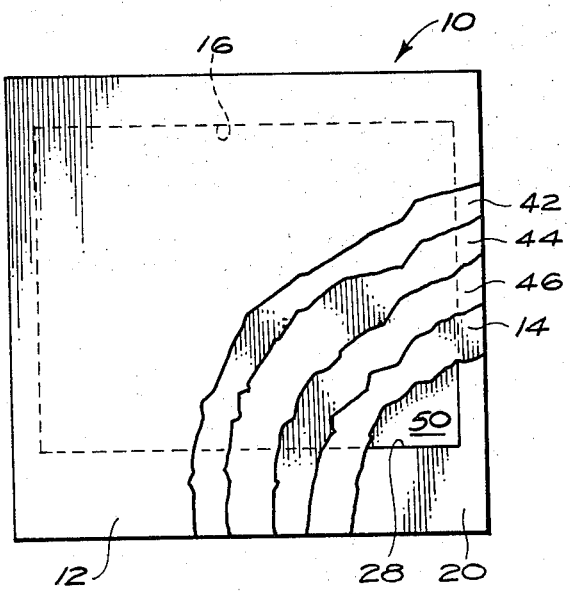
FIG. 1 is a front plan view of a self-processing film unit of this invention, partly cut away to show a portion of the inner construction.

The adhesive compositions of this invention comprise a polymeric acidic component which has at least 3 milliequivalents of acid per gram of component. This component includes one or more acidic polymers. As used in this specification and in the claims, the term "acidic polymer" refers to a polymer having acid groups, such as carboxy, sulfo, phosphono or sulfino groups. Many such acidic polymers are known, as described for example, in U.S. Pat. No. 3,362,819 (issued Jan. 9, 1968 to Land) and *Research Disclosure,* publication 13525, July, 1975 (published by Industrial Opportunities, Ltd., Homewell, Havant Hampshire, PO9 1EF United Kingdom).

The acidic polymers useful in this invention are typically condensation or addition polymers which have the desired adhesive and neutralizing capabilities. Preferably, the adhesive compositions exhibit a bond seal strength of at least 450 g/cm, and more preferably of at least 590 g/cm, as measured by performing 180° peel tests on a commercially available Instron Tensile Tester, Model 1101 or 1130. Adhered samples for peel tests were prepared in advance by sealing a mask material to various substrates such as a photosensitive element, using heat and pressure. A more detailed description of the peel tests and equipment used is given hereinafter immediately preceding the Examples.

The adhesive compositions of this invention are preferably used as mask adhesives in image-recording materials where they are open or exposed to contact with alkaline processing compositions. In other words, the mask adhesives are subject to contact with the alkaline processing compositions during processing of the image area.

The acidic polymers useful in this invention generally have inherent viscosities in the range of from about 0.30 to about 1.5, and preferably from about 0.35 to about 1.0, as measured in a suitable solvent, such as dioxane or a pH 5 buffer solution, at a concentration of 0.25 g/dl of solution.

Preferably, the acidic polymers useful in this invention comprise from about 25 to about 90 percent, by weight, of units derived from one or more acidic monomers of the formula (I):

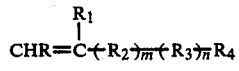

wherein each of m and n is 0 or 1, and more preferably, each is 0. Each of R and $R_1$ is hydrogen; methyl; halo, e.g. fluoro, chloro or bromo; or a monovalent acidic radical, e.g. carboxy. More preferably, each of R and $R_1$ is hydrogen or methyl, and most preferably, each is hydrogen.

$R_2$ is oxy, carbonyl, carbonyloxy or carbonylimino. More preferably, $R_2$ is carbonyloxy or carbonylimino and most preferably, is carbonylimino. $R_3$ is a divalent aliphatic, alicyclic or aromatic radical containing carbon and hydrogen, and optionally, oxygen atoms. More preferably, $R_3$ is a divalent hydrocarbon, typically of 1 to 20 carbon atoms, such as alkylene, arylene, cycloalkylene, arylenealkylene, alkylenearylene or arylenebisalkylene. More specifically, $R_3$ is alkylene, typically of 1 to 12 carbon atoms, such as methylene, ethylene, propylene, 2,2-dimethyl-1,3-propylene, 1,1-dimethylethylene, 2-methyl-1,3-propylene or decylene; or arylene, typically of 6 to 18 carbon atoms, such as phenylene, naphthylene or xylylene.

$R_4$ is a monovalent acid radical, such as carboxy, sulfo, phosphono or sulfino; alkyl, typically of 1 to 6 carbon atoms, e.g. methyl, 2-methylpropyl or hexyl; or alkoxycarbonyl, typically of 2 to 7 carbon atoms, e.g. methoxycarbonyl. When $R_4$ is alkyl or alkoxycarbonyl, at least one of R or $R_1$ is a monovalent acid radical, such as carboxy. More preferably, $R_4$ is carboxy.

Exemplary acidic monomers which are useful in the practice of this invention are acrylic acid, methacrylic acid, aconitic acid, acryloyloxypropionic acid, citraconic acid, chlorofumaric acid, fumaric acid, itaconic acid, maleic acid, α-methylene glutaric acid, crotonic acid, 2-acrylamido-2-methylpropanesulfonic acid, 2-methacrylamido-2-methylpropanesulfonic acid, 3-acryloyloxybutanesulfonic acid, vinylsulfonic acid, methacryloyloxyethyl-1-sulfonic acid and p-styrene sulfonic acid. Acrylic acid is a preferred monomer. The acidic monomers useful herein are commercially available or can be readily prepared by suitable techniques known to a person of ordinary skill in the art.

In addition, the acidic polymers described herein comprise from about 10 to about 75 percent, by weight, of units derived from one or more additional polymerizable, ethylenically unsaturated monomers. Any such monomer or monomers can be used as long as the resulting acidic polymer has the neutralizing and adhesive capabilities which have been described above in this specification. The additional monomer(s) can provide crosslinking capability to the polymer if desired.

Typical additional ethylenically unsaturated monomers are represented by the formula (II):

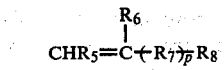

wherein p is 0 or 1, and preferably 1. Each of $R_5$ and $R_6$ is hydrogen, methyl or halo, e.g. fluoro, chloro or bromo. More preferably, each of $R_5$ and $R_6$ is hydrogen or methyl and most preferably, hydrogen. $R_7$ is carbonyl, carbonyloxy or carbonylimino, and more preferably, carbonyloxy.

$R_8$ is hydrogen or a monovalent aliphatic, alicyclic or aromatic radical containing carbon and hydrogen, and optionally, oxygen atoms provided, however, when $R_8$ is hydrogen and p is 1, $R_7$ is carbonylimino. More preferably, $R_8$ is a monovalent hydrocarbon, typically of 1 to 20 carbon atoms, such as alkyl including aralkyl, aryl including alkaryl, allyl or cycloalkyl. Most preferably, $R_8$ is alkyl, typically of 1 to 12 carbon atoms, such as methyl, ethyl, isopropyl, n-butyl, decyl or lauryl.

Exemplary monomers having formula (II) are n-butyl acrylate, trans-1,2-dichloroethylene, 2-norbornylmethyl methacrylate, ethyl 2-chloromethacrylate, methyl acrylate, n-lauryl methacrylate, N-isopropylacrylamide, acrylamide and vinyl acetate. n-Butyl acrylate is a preferred monomer. These monomers are commercially available or can be readily prepared by suitable techniques known to a person of ordinary skill in the art.

Preferably, the acidic polymers described herein comprise from about 45 to about 80 percent, by weight, of units derived from monomers of formula (I) and from about 20 to about 55 percent, by weight, of units derived from monomers of formula (II).

Other acidic polymers useful in the adhesive compositions of this invention include those which comprise units derived from two or more acidic monomers. For example, a particularly useful acidic polymer has units derived from a carboxy-containing monomer and a sulfo-containing monomer. In such a polymer, it is preferred that from about 5 to about 50 percent, by weight, of units are derived from a specific class of acidic monomers, namely, those of formula (III):

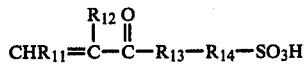

wherein each of $R_{11}$ and $R_{12}$ is hydrogen, methyl or halo, e.g. fluoro, chloro or bromo; $R_{13}$ is oxy or imino; and $R_{14}$ is alkylene, typically of 1 to 12 carbon atoms, e.g. methylene, trimethylene or 1,1-dimethylethylene, or arylene, typically of 6 to 8 carbon atoms, e.g. phenylene, naphthylene or xylylene.

Representative acidic polymers useful in this invention are poly(methyl acrylate-co-acrylic acid), poly(n-butyl acrylate-co-acrylic acid), poly(vinyl acetate-co-acrylic acid), poly(n-lauryl methacrylate-co-acrylic acid), poly(n-butyl methacrylate-co-3-methacryloyloxypropanesulfonic acid), poly(N-isopropylacrylamide-co-acrylic acid), poly(methyl methacrylate-co-n-butyl acrylate-co-acrylic acid), poly(n-butyl acrylate-co-2-acrylamido-2-methylpropanesulfonic acid) and poly(n-butyl acrylate-co-acrylic acid-co-2-acrylamido-2-methylpropanesulfonic acid).

The polymeric acidic component described herein can be a mixture of acidic polymers, such as preferably, a mixture of one or more sulfo-containing polymers and one or more carboxy-containing polymers. Typically sulfo-containing polymers are those having units derived from one or more monomers of formula (III). Such mixtures contain from about 1 to about 99 weight percent, and preferably from about 30 to about 80 weight percent of sulfo-containing polymer(s), based on total polymeric acidic component weight.

All of the acidic polymers described hereinabove are useful in the adhesive compositions of our invention. A co-worker, Wayne A. Bowman, has done further work with our adhesive compositions and has found that a specific class of acidic polymers within the broad class described herein unexpectedly provides certain advantages (e.g. heat sealing at lower temperatures) when used in such compositions. The improved adhesive compositions discovered by Mr. Bowman comprise the sulfo-containing polymers having units derived from monomers of formula (III) described hereinabove, and are disclosed and claimed in his U.S. patent application Ser. No. 208,747, filed concurrently herewith and entitled SULFO-CONTAINING ADHESIVE COMPOSITIONS AND SELF-PROCESSING PHOTOGRAPHIC PRODUCTS CONTAINING SAME.

The polymerization conditions which can be used for making polymers useful in this invention are those commonly employed in condensation and addition polymerization techniques known in the art. For the preferred addition polymers, these techniques include suspension and solution techniques. In these techniques, polymerization temperature is subject to wide variation as it depends upon several variables, but it is generally in the range of from about 20° to 120° C. The pressure employed in the polymerization, if any, is usually only sufficient to maintain the reaction mixture in liquid form. The polymerization can be carried out in a suitable vehicle, for example, in water or mixtures of water with water miscible solvents, e.g. methanol, ethanol, propanol, isopropanol or butanol, or in an organic solvent or in mixtures of organic solvents, e.g. N,N-dimethylformamide, acetone, dimethyl sulfoxide, tetrahydrofuran or methoxyethanol. Generally, the concentration of polymer in solution or suspension is up to about 40%, by weight, and preferably from about 10 to about 25%, by weight, based on the total weight. Suitable catalysts include free radical catalysts, e.g. hydrogen peroxide, cumene hydroperoxide or water soluble azo type initiators. Suitable non-ionic, ionic and amphoteric surface active agents can be used if desired. In redox polymerization systems, the usual ingredients can be employed. If desired, the polymer can be isolated from reaction medium by freezing, salting out, precipitation or any other suitable procedure.

The concentration of polymeric acidic component in the adhesive compositions of this invention is generally in the range of from about 70 to about 96 percent and preferably, from about 80 to about 90 percent, by weight. In a dried adhesive layer of from about 0.002 to about 0.013 mm (0.1 to 0.5 mils) thick, the coverage of polymeric acidic component is generally from about 2 to about 12 g/m$^2$ (0.2–1.2 g/ft$^2$), and preferably from about 3 to about 7 g/m$^2$ (0.3–0.65 g/ft$^2$), of surface area.

The adhesive compositions of this invention also comprise a substantially immobile, blocked photographic development restrainer, a substantially immobile, blocked competing photographic developer or mixtures of either or both.

Photograpic development restrainers are known to be useful to restrain photographic development. The restrainers useful in this invention are "blocked," meaning they have a built-in blocking group which prevents activation of the restraining function before contact with the processing composition. The restrainers useful in this invention can have any suitable blocking group. Typically, when a blocked photographic development restrainer is subjected to an alkaline environment, such as an alkaline photographic processing composition, the blocking moieties are cleaved, providing activated photographic development restrainers.

The restrainers useful in this invention are also "substantially immobile," meaning they are immobilized to prevent their migration, to any appreciable extent, out of the mask adhesive into image-recording layers. One conventional way of immobilizing the restrainer is to attach a ballasting group. In some restrainers, the blocking group can also serve as a ballasting group.

Any suitable substantially immobile, blocked photographic development restrainer can be used, including those described in *Research Disclosure,* publication 15162, p. 84, Column 1, November, 1976 (published by Industrial Opportunities, Ltd., Homewell, Havant Hampshire, PO9 1EF, United Kingdom). Typical restrainers are those described in U.S. Pat. No. 4,009,029 (issued Feb. 22, 1977 to Hammond et al), the disclosure of which is incorporated herein by reference. Such restrainers are represented by the formula (IV):

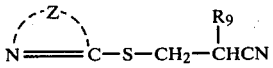

wherein $R_9$ is hydrogen, alkyl, typically of 1 to 8 carbon atoms, e.g. methyl, ethyl, chloromethyl, isopropyl or hexyl, or aryl, typically of 6 to 12 carbon atoms, e.g. phenyl, xylyl or naphthyl; and Z comprises the nonmetallic atoms necessary to complete a 5- or 6-membered substituted or unsubstituted heterocyclic ring. More preferably, these heterocyclic rings are single rings as opposed to fused or condensed rings in which the atoms are members of more than one heterocyclic ring. Typical heterocyclic nitrogen moieties represented by formula (IV) include triazoles (e.g. 1,2,4-triazoles), benzimidazoles, pyrimidines, monoazoles (e.g. benzoxazoles or benzothiazoles) and tetrazoles. Most preferably, the blocked development restrainers useful in this invention contain a tetrazole nucleus, such as a phenyl-substituted tetrazole nucleus.

One such preferred substantially immobile, blocked development restrainer is 5-(2-cyanoethylthio)-1-phenyl-tetrazole.

Competing photographic developers are well known in the photographic art. Like the substantially immobile, blocked restrainers discussed hereinabove, the competing photographic developers useful in this invention are both substantially "immobile" and "blocked." In this form, they will not migrate into image-recording layers and will not be activated until contact with the processing composition.

Any suitable substantially immobile, blocked competing developer can be used in this invention. Preferred compounds, however, are those described in U.S. Pat. No. 4,201,578 (issued May 6, 1980 to Abbott) the disclosure of which is incorporated herein by reference. Upon contact with an alkaline processing composition, the ester groups of these competing developers hydrolyze allowing the resulting hydroquinone to take part in development. The described competing developers are represented by the formula (V):

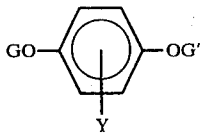

wherein G is hydrogen, $—COR_{10}$ or $—SO_2R_{10}$, and preferably hydrogen; and G' is $—COR_{10}$ or $—SO_2R_{10}$, and preferably $—COR_{10}$. $R_{10}$ is alkyl, typically of 1 to 20 carbon atoms, e.g. methyl, chloromethyl, ethyl, isopropyl, t-butyl, decyl or lauryl; or aryl, typically of 6 to 12 carbon atoms, e.g. phenyl, xylyl or naphthyl, as long as the compound can be hydrolyzed to the corresponding hydroquinone. Preferably, $R_{10}$ is alkyl.

Y is hydrogen; alkyl, typically of 1 to 6 carbon atoms, e.g. methyl, ethyl, isopropyl or t-butyl; alkoxy, typically of 1 to 6 carbon atoms, e.g. methoxy or ethoxy; or aryl, typically of 6 to 8 carbon atoms, e.g. phenyl, m-tolyl or p-methoxyphenyl, as long as the compound will diffuse at a sufficient rate when the acyl or sulfonyl group or groups are hydrolyzed. Preferably, Y is alkyl.

Exemplary useful substantially immobile, blocked competing photographic developers are hydroquinone diacetate, hydroquinone monohexanoate, hydroquinone monoacetate, t-butylhydroquinone monoacetate, hydroquinone monobenzoate, p-methylsulfonyloxyphenol, and p-tolylsulfonyloxyphenol. A preferred compound is t-butylhydroquinone monoacetate.

The substantially immobile, blocked photographic development restrainer or substantially immobile, blocked competing photographic developer is present in the adhesive compositions of this invention in a concentration in the range of from about 2 to about 20 percent, and preferably, from about 5 to about 10 percent, by weight based on total composition weight. In a dried adhesive layer of from about 0.002 to about 0.013 mm (0.1 to 0.5 mils) thick, the coverage of such blocked compounds is generally from about 0.1 to about 2 $g/m^2$ (10–200 $mg/ft^2$), and preferably from about 0.15 to about 0.75 $g/m^2$ (15–70 $mg/ft^2$), of surface area.

The adhesive compositions can also comprise various addenda commonly used in the art to enhance bond strength, improve coatability, prevent sticking of the coated material in roll form and provide surface texture and reflection properties. Typical addenda include dyes, pigments, fillers, binders, polymer modifiers and waxes. Preferably, the compositions comprise silica, generally in an amount to provide coverage of from about 0.2 to about 0.7 $g/m^2$ (20–65 $mg/ft^2$) of surface area.

A preferred adhesive composition of this invention comprises poly(n-butyl acrylate-co-acrylic acid), 5-(2-cyanoethylthio)-1-phenyltetrazole and silica.

Another preferred adhesive composition within the scope of this invention comprises poly(n-butyl acrylate-co-acrylic acid), poly(n-butyl acrylate-co-2-acrylamido-2-methylpropanesulfonic acid), 5-(2-cyanoethylthio)-1-phenyltetrazole and silica. The weight ratio of the carboxy-containing polymer to the sulfo-containing polymer in this composition is preferably in the range of from about 50:50 to about 70:30.

Still another preferred adhesive composition comprises poly(n-butyl acrylate-co-acrylic acid-co-2-acrylamido-2-methylpropanesulfonic acid), 5-(2-cyanoethylthio)-1-phenyltetrazole and silica.

The adhesive compositions of this invention can be used in a wide variety of self-processing image-recording film units, and particularly in self-processing photographic film units. Typical formats of such film units are disclosed, for example, in U.S. Pat. Nos. 2,543,181; 2,983,606; 3,362,819; 3,415,644; 3,415,646; 3,647,437; 3,635,707; 3,756,815; Canadian Pat. Nos. 674,082 and 928,559; and *Research Disclosure,* publication 17643, paragraph XXIII, p. 30, December, 1978 (published by Industrial Opportunities, Ltd., Homewell, Havant Hampshire, PO9 1EF, United Kingdom). Preferred self-processing photographic products are of the type described in U.S. Pat. No. 4,042,395 (issued Aug. 16, 1977 to Tone et al), 4,061,496 (issued Dec. 6, 1977 to Hannie et al) and 4,190,447 (issued Feb. 26, 1980 to Coil et al) the disclosures of which are incorporated herein by reference.

A typical self-processing film unit of this invention has a photosensitive element, a cover sheet and a mask comprising an aperture adapted to receive the processing composition. Typically, the photosensitive element comprises at least one image-recording layer and an image-receiving layer. The mask is bonded to the photosensitive element by the adhesive composition of this invention. Preferably, the film units comprise one or more radiation-sensitive, image-recording layers and associated dye-providing layers.

In addition, such film units can also contain other layers, e.g. neutralizing layers, timing layers, barrier layers, reflective layers, opaque layers, spacer layers, interlayers and the like. The film units can be treated with an alkaline processing composition to effect or initiate development. This processing composition can be supplied by external means or by an internal means, such as a container or rupturable pouch containing the processing composition, which is part of the film unit, as described, for example, in U.S. Pat. No. 4,188,219 (issued Feb. 12, 1980 to Cawley). In addition, the film units can have a means for collecting excess processing composition such as a trap element.

In general, the alkaline processing composition contains a developing agent, although the composition can also be simply an alkaline solution when the developing agent is elsewhere in the film unit. In the latter case, the alkaline solution activates the incorporated developing agent.

The adhesive compositions of this invention can also be used in an image-recording element which has no image-receiving layer. Such elements are not diffusion or image transfer film units. These elements can be used alone for recording and viewing an image or as part of a self-processing film unit. Typically, such an element comprises a support, a plurality of layers, including an image-recording layer, e.g. a photosensitive silver halide layer, and a mask. The adhesive composition of this invention is used to bond the mask to the image-recording layer or an intervening layer.

A detailed description of the components of the photographic products of this invention and the processes for using them is given in *Research Disclosure,* publication 15162, November, 1976 (published by Industrial Opportunities, Ltd., Homewell, Havant Hampshire, PO9 1EF, United Kingdom).

In bonding the mask to an appropriate layer in the elements and film units of this invention, the acidic adhesive composition can be coated in one or more layers to give the desired adhesive and photographic results. Of course, the acidic adhesive composition can be used to directly or indirectly bond the mask to the image-recording layer. For example, there may be intervening layers or other adhesives between the acidic adhesive composition and the mask or between the acidic adhesive composition and the image-recording layer. Within the meaning of this disclosure, such masks are permanently bonded to such image recording layers. As used in this specification and in the claims, the term "permanently" means that the bonded layers and mask remain adhered together during ordinary usage. This is opposed to known "temporary" bonds that allow layers to be peeled apart for usage.

The mask is sometimes a material, e.g. a polyester, such as poly(ethylene terephthalate), an organic-coated polymeric film or a laminate of a polymeric film, metal foil and paper, to which the acidic adhesive composition does not readily adhere. In such instances, it is advantageous to coat the mask with one or more "primers" or subbing layers which improve adhesion between the mask and the adhesive composition of this invention. Suitable primers are known and include polyesters which can be coated out of organic solvents such as toluene, tetrahydrofuran, dioxane or chlorinated hydrocarbons.

A preferred primer for use in the film units of this invention is a two-layer laminate. This laminate comprises a polyester, such as poly[ethylene-co-tetramethylene (72.5:27.5, molar ratio), azelate-co-terephthalate (47.5:52.5, molar ratio)], coated on the mask, and poly(ethylene-co-vinyl acetate) coated on the polyester. The adhesive composition of this invention is applied over the poly(ethylene-co-vinyl acetate).

Figure 3:
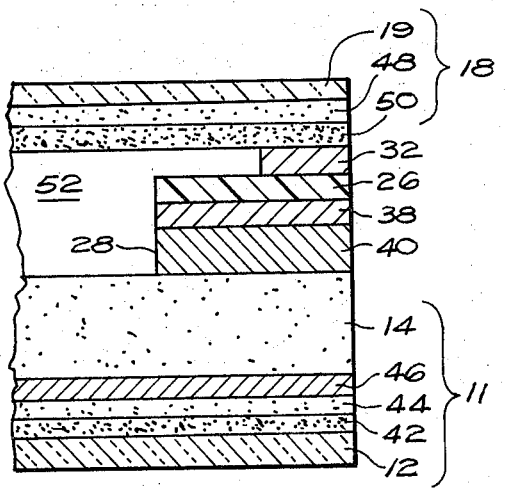
FIG. 3 is an exaggerated partial, sectional view taken along line 3—3 of FIG. 2.
Figure 2:
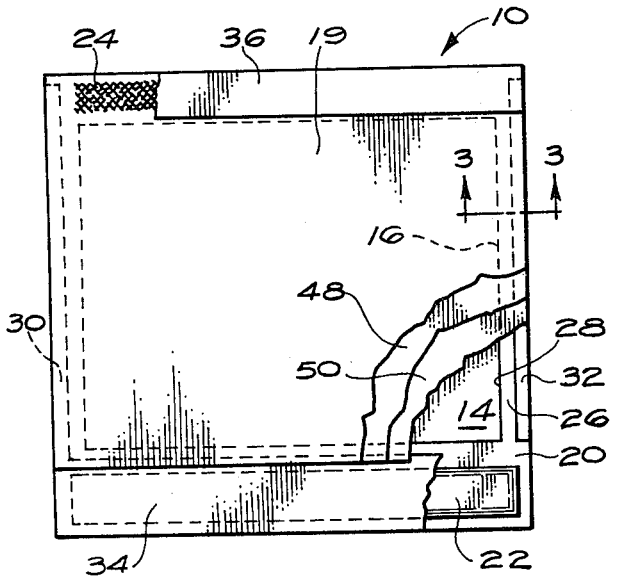
FIG. 2 is a rear plan view of the film unit illustrated in FIG. 1, partly cut away to show portions of the inner construction.

FIGS. 1–3 illustrate a preferred self-processing photographic film unit of the present invention. Referring to FIGS. 1 and 2, film unit 10 comprises support 12 which has a textured or glossy, substantially planar outer surface which forms the entire front or viewing surface of film unit 10. Support 12 is provided with an image-receiving layer 42, one or more reflective layers 44, one or more opaque layers 46 and one or more radiation-sensitive image-recording layers 14, e.g. photographic silver halide layers, to form photosensitive element 11 (see FIG. 3). The visible image occupies the image area indicated by dashed rectangle 16. The border occupies the area outside dashed rectangle 16.

Covering film 19 is provided with one or more neutralizing layers 48 and one or more timing layers 50 to form cover sheet 18 (see FIG. 3). Cover sheet 18 is arranged in superposition with and connected to support 12 with intermediate sheet 20 and spacer rails 30 and 32. Preferably, support 12 and cover sheet 18 are transparent to actinic radiation so that film unit 10 can be exposed to actinic radiation from the side illustrated in FIG. 2 and viewed from the side illustrated in FIG. 1.

Film unit 10 has a container or rupturable pouch 22 which can be of any suitable type known in the art. Pouch 22 carries a suitable alkaline processing composition capable of reacting with portions of radiation-sensitive, image-recording layer(s) 14 to produce a visible image. When appropriate pressure is applied to pouch 22, the processing composition is discharged and spread between image-recording layer(s) 14 and cover sheet 18 in a manner known in the art. At the end of film unit 10, opposite pouch 22, is trap element 24 having enough volume to receive and hold excess processing composition.

Intermediate sheet 20 is a unitary, multifunction sheet member which extends between and couples together support 12 and cover sheet 18. It also provides mask 26 which forms exposure aperture 28. Further, intermediate sheet 20 provides pouch attaching cover 34 and trap cover 36.

Mask 26 and spacer rails 30 and 32 provide requisite spacing between radiation-sensitive, image-recording layer(s) 14 and cover sheet 18 for the alkaline processing composition. Preferably, mask 26 and spacer rails 30 and 32 are opaque to actinic radiation. This opacity can be provided either with opacifying agents in the mask and spacer rails themselves or with an opaque layer coated thereon.

Referring to FIG. 3, photosensitive element 11 comprises transparent support 12 which has thereon, in sequence, image-receiving layer 42, light reflecting layer 44, opaque layer 46 and radiation-sensitive, image-recording layer(s) 14. Mask 26 is bonded to element 11 with acidic adhesive 40. Primer layer(s) 38 provide(s) improved adhesion between mask 26 and acidic adhesive 40. Acidic adhesive 40 is open to exposure to alkaline processing composition when that composition is introduced into cavity 52 between layers 14 and 50. Spacer rail 32 is adhered to cover sheet 18 and mask 26 by any suitable adhesive (not shown) known in the art, such as a poly(ethylene-co-vinyl acetate)-based adhesive. Alternatively, cover sheet 18 can be self-adhering to spacer rail 32. Transparent cover sheet 18 comprises transparent covering film 19, which has thereon, in sequence, acid neutralizing layer 48 and timing layer(s) 50.

Evaluation of the bond strength of the adhesive compositions of this invention was made using the following procedure and equipment.

Preparation of Peel Samples

Poly(ethylene terephthalate) mask coated with the appropriate primer(s) and adhesive compositions of this invention, and various substrates to which the mask was to be bonded were cut into sample pieces 2.54×5.4 cm in size. Each mask sample was bonded to a substrate sample at one end to form a peel sample between two heated jaws at 1.4 kg/cm$^2$ (20 psi) jaw pressure and various jaw temperatures for 0.4 second. The sealed area was 2.54×0.76 cm in size.

Post Bond Conditioning

Bonds were tested at different intervals after sealing to determine the effects of aging on the strength of the adhesive compositions.

In the "fresh" test, peel samples were place in a 24° C./50% relative humidity environment for from 4 to 24 hours prior to peel tests under these conditions.

In the "one week natural aging" test, peel samples were placed in a 24° C./50% relative humidity environment for one week prior to peel tests under these conditions.

In the "four day, 49° C./10% RH" test, peel samples were placed in a 49° C./10% relative humidity environment for 4 days prior to peel tests at 24° C. and 50% relative humidity.

In the "one day, 32° C./90% RH" test, peel samples were placed in a 32° C./90% relative humidity environment for at least 24 hours prior to peel tests under these conditions.

Peel Tests

Figure 4:
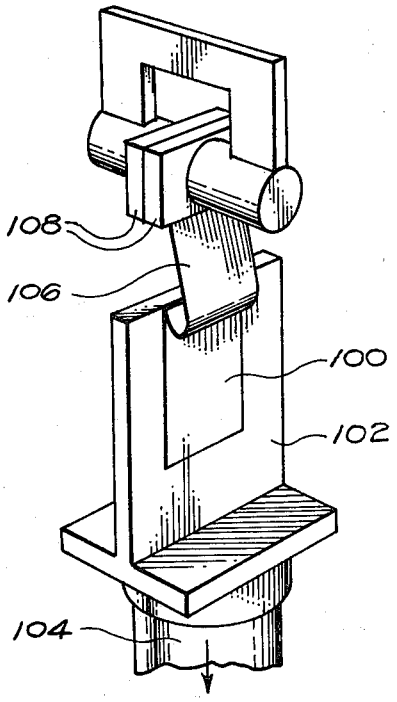
FIG. 4 is a perspective view of equipment used to determine bond strengths of adhesives adhering a mask and another material as described in the following Examples.

Peel tests of the peel samples were performed with a commercially-available Instron Tensile Tester in the following manner. Referring to FIG. 4, the entire substrate 100 of a peel sample was adhered to a vertical mounting plate 102 on crosshead 104 with double adhesive pressure sensitive tape. The unsealed end of the mask 106 was opened away from substrate 100 by 180° and fixed in pneumatic jaws 108.

Crosshead 104 was then pulled downward away from jaws 108 at a rate of 25.4 cm/min. The force required to break the seal between mask 106 and substrate 100 was recorded.

The following examples illustrate the practice of the present invention.

EXAMPLES 1 AND 2

Bond Seal Strengths of Adhesive Compositions

These examples illustrate the bond seal strengths of two adhesive compositions of this invention. These compositions were used to bond a poly(ethylene terephthalate) mask to various substrates. The poly(ethylene terephthalate) mask was coated with two primer layers prior to being coated with the adhesive composition. The first primer layer was a coating of a polyester, poly[ethylene-co-tetramethylene (72.5:27.5, molar ratio) azelate-co-terephthalate (47.5:52.5, molar ratio)], and the second layer was a coating of a commercially available poly(ethylene-co-vinyl acetate)-based adhesive.

The adhesive composition of Example 1 included poly(n-butyl acrylate-co-2-acrylamido-2-methylpropanesulfonic acid) (25:75 weight ratio) (0.1 g), poly(n-butyl acrylate-co-acrylic acid) (30:70 weight ratio) (0.1 g) and 5-(2-cyanoethylthio)-1-phenyltetrazole (25 mg).

The adhesive composition of Example 2 included poly(n-butyl acrylate-co-2-acrylamido-2-methylpropanesulfonic acid) (25:75 weight ratio) (0.2 g) and 5-(2-cyanoethylthio)-1-phenyltetrazole (25 g).

Each adhesive composition was coated over the primer layers at a coverage of about 2.25 g/m$^2$.

The substrate materials listed in Table I were as follows: A=a typical gelatin-containing silver halide emulsion layer of a photosensitive element of the type described in Example 2 of U.S. Pat. No. 4,061,496; B=a typical timing layer of poly(acrylonitrile-co-vinylidene chloride-co-acryic acid); C=cellulose acetate film; and D=polystyrene film.

The conditions of sealing and the resulting fresh bond seal strengths are listed in Table I below. It is clear from the data listed therein that the adhesive compositions provide high strength permanent bonds (greater than 450 g/cm) at several sealing temperatures when used to bond the primed mask to a gelatin-containing layer and a timing layer. The adhesive compositions did not effectively bond directly to cellulose acetate and polystyrene. However, the adhesive compositions would form satisfactory bonds with the cellulose acetate and polystyrene films when appropriate adhesion promoting coatings are used.

TABLE I

| Adhesive Composition | Sealing Temp. (°C.) | Bond Strengths (g/cm) Materials A | B | C | D |
|---|---|---|---|---|---|
| Example 1 | 135 | 730 | 795 | 0 | 0 |
| | 149 | 739 | 810 | 9 | 0 |

TABLE I-continued

| Adhesive Composition | Sealing Temp. (°C.) | Bond Strengths (g/cm) Materials A | B | C | D |
|---|---|---|---|---|---|
| | 163 | 805 | 858 | 0 | 0 |
| Example 2 | 135 | 883 | 836 | 0 | 0 |
| | 149 | 877 | 899 | 0 | 0 |
| | 163 | 860 | 924 | 0 | 0 |

EXAMPLE 3

Bond Seal Strengths of Adhesive Composition

An adhesive composition of this invention was used to bond a primed mask of the type described in Examples 1 and 2 hereinbefore to a gelatin-containing overcoat layer of a photosensitive element of the type described in Example 2 of U.S. Pat. No. 4,061,496. The bond seal strengths of this composition was then determined in the manner described in Examples 1 and 2 hereinbefore except that the coverage of acidic adhesive was 6.1 g/m$^2$.

The adhesive composition comprised poly(n-butyl acrylate-co-acrylic acid) (30:70 weight ratio) (5.6 g) and 5-(2-cyanoethylthio)-1-phenyltetrazole (490 mg). The conditions of sealing and the resulting bond seal strengths under various keeping conditions are listed in Table II hereinafter. The data from Table II illustrates that this adhesive composition has high bond strength under most conditions when sealed at conventional sealing temperatures. The bond strengths appear to increase with age and are advantageously high at high use temperature and humidity conditions.

TABLE II

| Adhesive Composition | Sealing Temp. (°C.) | Fresh | 1 week at 24° C., 50% R.H.* | Bond Sealing Strength (g/cm) 4 days at 49° C., 10% R.H.* | One day at 32° C., 90% R.H.* |
|---|---|---|---|---|---|
| Example 3 | 121 | 34 | 59 | 434 | 675 |
| | 135 | 515 | 571 | 828 | 677 |
| | 149 | 485 | 602 | 923 | 697 |

*Relative Humidity

EXAMPLES 4–11

Bond Seal Strengths and Photographic Effects of Adhesive Compositions

I. Bond Seal Strengths

Several adhesive compositions of this invention were used to bond a primed mask of the type described in Examples 1 and 2 hereinbefore to a gelatin-containing overcoat layer of a photosensitive element of the type described in Example 2 of U.S. Pat. No. 4,061,496. The bond seal strengths of these compositions were determined in the manner described in Examples 1 and 2 hereinbefore except that the coverage of acidic adhesive was 6.1 g/m$^2$. A known adhesive composition outside the scope of this invention comprising non-acidic poly(ethylene-co-vinyl acetate) and designated Control A was similarly tested.

The adhesive compositions of Example 4 comprised poly(n-butyl acrylate-co-2-acrylamido-2-methylpropanesulfonic acid) (25:75 weight ratio) (5.2 g), 5-(2-cyanoethylthio)-1-phenyltetrazole (420 mg) and silica (520 mg). The composition of Example 5 was similar except it comprised a 37.5:62.5 mixture (by weight) of poly(n-butyl) acrylate-co-acrylic acid) (30:70 weight ratio), and poly(n-butyl acrylate-co-2-acrylamido-2-methylpropanesulfonic acid) (25:75 weight ratio). Examples 6, 7 and 8 were similar to Example 5 except that the polymer mixtures were present in 50:50, 62.5:37.5 and 60:40 weight ratios, respectively.

Examples 9–11 were similar to Example 4 except that poly(n-butyl acrylate-co-2-acrylamido-2-methylpropane sulfonic acid-co-acrylic acid) was used instead of the copolymer. These terpolymers were prepared from the appropriate monomers in weight ratios of 30:35:35, 30:31.5:38.5 and 30:28:42 for Examples 9–11, respectively.

The conditions of sealing and the resulting bond seal strengths under various keeping conditions are listed in Table III below. All of the adhesive compositions, including the control provided high strength bonds over most keeping conditions. As shown in Table III, adhesive strength was lost be Examples 4–6 after prolonged exposure to extremely high humidity.

TABLE III

| Adhesive Composition | Sealing Temp. (°C.) | Bond Sealing Strength (g/cm) Fresh | 1 week at 24° C., 50% R.H.* | 4 days at 49° C., 10% R.H.* | One day at 32° C., 90% R.H.* |
|---|---|---|---|---|---|
| Control A | 121 | 839 | 900 | 1134 | 630 |
| | 135 | 859 | 912 | 1062 | 575 |
| | 149 | 884 | 928 | 1177 | 609 |
| Example 4 | 121 | 794 | 795 | 844 | 20 |
| | 135 | 785 | 798 | 860 | 11 |
| | 149 | 815 | 835 | 851 | 12 |
| Example 5 | 121 | 513 | 541 | 832 | 268 |
| | 135 | 525 | 514 | 832 | 293 |
| | 149 | 535 | 508 | 806 | 276 |
| Example 6 | 121 | 659 | 528 | 826 | 373 |
| | 135 | 647 | 581 | 841 | 377 |
| | 149 | 706 | 610 | 872 | 374 |
| Example 7 | 121 | 546 | 552 | 931 | 768 |
| | 135 | 727 | 730 | 935 | 763 |
| | 149 | 843 | 740 | 955 | 741 |
| Example 8 | 121 | 450 | 511 | 765 | 557 |
| | 135 | 631 | 691 | 813 | 625 |
| | 149 | 626 | 717 | 837 | 712 |
| Example 9 | 121 | 1062 | 1059 | 1154 | 565 |
| | 135 | 1082 | 998 | 1164 | 576 |
| | 149 | 1098 | 1094 | 1141 | 560 |
| Example 10 | 121 | 1005 | 1111 | 1168 | 656 |
| | 135 | 1008 | 1104 | 1184 | 654 |
| | 149 | 1008 | 1180 | 1176 | 646 |
| Example 11 | 121 | 1037 | 1116 | 1121 | 732 |
| | 135 | 1002 | 1090 | 1116 | 750 |
| | 149 | 987 | 1071 | 1106 | 750 |

*Relative Humidity

II. Photographic Effects

Several diffusion transfer film units of the type described in Example 1 of U.S. Pat. No. 4,061,496 (issued Dec. 6, 1977 to Hannie et al) were prepared. Several different adhesive compositions were used to bond a primed mask of the type described in Examples 1 and 2 hereinabove to the gelatin-containing overcoat (referenced layer 12 in that Example) of the photosensitive element. Each film unit was exposed to a test object and a processing composition was spread between the photosensitive element and the cover sheet by a pair of juxtaposed pressure rollers at either 16° or 22° C.

Some of the film units so exposed and processed were evaluated for border bleed. These film units were subjected to a 60° C./40% R.H. environment for 16 hours. The amount of border bleed was determined by measuring the increase in red, green and blue densities in the normally white borders of the film units with a conventional densitometer. The sensitometric data are listed in Table IV below.

An evaluation of dark edge line is also presented in Table IV.

In the data presented in Table IV for dark edge line, an evaluation of 4 or less is good and means that very little of that defect was observed. An evaluation of 5 or 6 is fair, but acceptable in quality. An evaluation of greater than 6 is poor and indicates that dark edge line was so prominent that the image would likely be unacceptable to users.

TABLE IV

| Adhesive | Border Bleed (density increase) Red | Green | Blue | Dark Edge Line processed at 22° C. | processed at 16° C. |
|---|---|---|---|---|---|
| Control A | 0.131 | 0.075 | 0.095 | — | 6 |
| Example 4 | 0.070 | 0.043 | 0.053 | — | 3 |
| Control B* | 0.185 | 0.105 | 0.081 | 4 | 6 |
| Example 4a** | 0.120 | 0.080 | 0.063 | 2 | 5 |
| Control C* | 0.164 | 0.071 | 0.063 | 5 | 8 |
| Example 4b** | 0.101 | 0.061 | 0.063 | 2 | 4 |
| Example 8 | 0.124 | 0.079 | 0.068 | 3 | 6 |
| Example 9 | 0.115 | 0.065 | 0.065 | 3 | 5 |
| Example 10 | 0.100 | 0.065 | 0.059 | 3 | 5 |
| Control D* | 0.176 | 0.100 | 0.078 | 5 | 8 |
| Example 4c** | 0.096 | 0.064 | 0.060 | 3 | 5 |
| Example 11 | 0.092 | 0.054 | 0.053 | 3 | 5 |

*Controls B–D were like Control A except the film units were from different coating runs.
**Examples 4a–4c were like Example 4 except the film units used were from different coating runs.

The data listed in Table IV shows that the adhesive compositions of this invention, when used as mask adhesives in self-processing film units, greatly improve border quality in those film units. The improvement in border bleed is most prominently seen in the reduction of red density since most border bleed is attributed to undesired migration of cyan dye. That is, border bleed generally shows up as a cyan color in the border. Density increases in the green and blue regions of the spectrum are also reduced in most cases. The adhesive compositions of this invention also provide marked reduction in dark edge line over the control adhesives at both processing temperatures but especially at the lower processing temperature when dark edge line is usually more prominent. The film units of this invention were consistently evaluated as 6 or less, and many units were evaluated as 4 or less.

Looking at Tables III and IV together, it is apparent that the control mask adhesives provided high strength bonds, but were severely deficient in photographic properties (i.e. border defects). However, the mask adhesives of this invention provide high bond strengths over most conditions while significantly reducing defects in the border.

This invention has been described in detail with particular reference to certain preferred embodiments thereof, but it will be understood that variations and modifications can be effected within the spirit and scope of the invention.

We claim:

1. An image-recording element comprising:

(1) a support, (2) a plurality of layers including an image-recording layer having an image area adapted to be processed by an alkaline processing composition, and (3) a mask providing an aperture adapted to receive said alkaline processing composition and a border which defines said image area, said mask being permanently bonded to said image-recording layer by a high strength adhesive composition which is disposed within said border and is subject to contact with said alkaline processing composition, said adhesive composition comprising: a polymeric acidic component adapted to neutralize said alkaline processing composition in said border and having at least 3 milliequivalents of acid per gram of said component, and a substantially immobile, blocked photographic development restrainer or a substantially immobile, blocked competing photographic developer.

2. The element of claim 1 wherein said polymeric acidic component comprises an acidic polymer having:

(a) from about 25 to about 90 percent, by weight, of units derived from an acidic monomer of the formula (I):

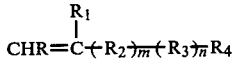

wherein each of m and n is 0 or 1; each of R and $R_1$ is hydrogen, methyl, halo or a monovalent acidic radical; $R_2$ is oxy, carbonyl, carbonyloxy or carbonylimino; $R_3$ is a divalent aliphatic, alicyclic or aromatic radical; and $R_4$ is a monovalent acid radical, alkyl or alkoxycarbonyl, provided that when $R_4$ is alkyl or alkoxycarbonyl, at least one of R or $R_1$ is a monovalent acid radical, and (b) from about 10 to about 75 percent, by weight, of units derived from an additional polymerizable, ethylenically unsaturated monomer.

3. The element of claim 2 wherein said acidic polymer comprises from about 45 to about 80 percent, by weight, of units derived from said monomer (I).

4. The element of claim 2 wherein said additional polymerizable, ethylenically unsaturated monomer has the formula (II):

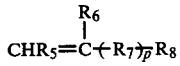

wherein p is 0 or 1; each of $R_5$ and $R_6$ is hydrogen, methyl or halo; $R_7$ is carbonyl, carbonyloxy or carbonylimino; and $R_8$ is hydrogen or a monovalent aliphatic, alicyclic or aromatic radical, provided that when $R_8$ is hydrogen and p is 1, $R_7$ is carbonylimino.

5. The element of claim 1 wherein said image-recording layer is a radiation sensitive image-recording layer.

6. A self-processing film unit comprising:

(1) a support, (2) a plurality of layers including an image-recording layer having an image area adapted to be processed by an alkaline processing composition and an image-receiving layer, and (3) a mask providing an aperture adapted to receive said alkaline processing composition and a border which defines said image area, said mask being permanently bonded to said image-recording layer by a high strength adhesive composition which is disposed within said border and is subject to contact with said alkaline processing composition, said adhesive composition comprising: a polymeric acidic component adapted to neutralize said alkaline processing composition in said border and having at least 3 milliequivalents of acid per gram of said component, and a substantially immobile, blocked photographic development restrainer or a substantially immobile, blocked competing photographic developer.

7. The film unit of claim 6 wherein said polymeric acidic component comprises an acidic polymer having:

(a) from about 25 to about 90 percent, by weight, of units derived from an acidic monomer of the formula (I):

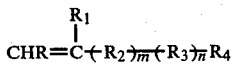

wherein each of m or n is 0 or 1; each of R and $R_1$ is hydrogen, methyl, halo or a monovalent acidic radical; $R_2$ is oxy, carbonyl, carbonyloxy or carbonylimino; $R_3$ is a divalent aliphatic, alicyclic or aromatic radical; and $R_4$ is a monovalent acid radical, alkyl or alkoxycarbonyl, provided that when $R_4$ is alkyl or alkoxycarbonyl, at least one of R and $R_1$ is a monovalent acid radical, and (b) from about 10 to about 75 percent, by weight, of units derived from an additional polymerizable, ethylenically unsaturated monomer of the formula (II):

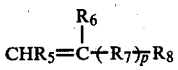

wherein p is 0 or 1; and each of $R_5$ and $R_6$ is hydrogen, methyl or halo; $R_7$ is carbonyl, carbonyloxy or carbonylimino; and $R_8$ is hydrogen or a monovalent aliphatic, alicyclic or aromatic radical provided that when $R_8$ is hydrogen and p is 1, $R_7$ is carbonylimino.

8. The film unit of claim 6 wherein said substantially immobile, blocked photographic development restrainer has the formula (IV):

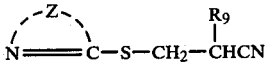

wherein $R_9$ is hydrogen, alkyl or aryl; and Z comprises the nonmetallic atoms necessary to complete a 5- or 6-membered heterocyclic ring.

9. The film unit of claim 6 wherein said substantially immobile, blocked competing photographic developer has the formula (V):

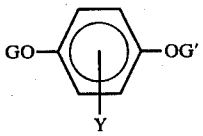

wherein G is hydrogen $—COR_{10}$ or $—SO_2R_{10}$; G' is $—COR_{10}$ or $—SO_2R_{10}$ wherein $R_{10}$ is alkyl or aryl; and Y is hydrogen, alkyl, alkoxy or aryl.

10. The film unit of claim 6 wherein said image-recording layer is a photographic silver halide layer.

11. The film unit of claim 6 further comprising a rupturable pouch containing said alkaline processing composition.

12. The film unit of claim 6 wherein said adhesive composition further comprises silica.

13. The film unit of claim 6 wherein said adhesive composition comprises poly(n-butyl acrylate-co-acrylic acid), 5-(2-cyanoethylthio)-1-phenyltetrazole and silica.

14. A self-processing photographic film unit comprising:

(1) a photosensitive element having an image area and comprising a transparent support having thereon the following layers in sequence: an image-receiving layer; a light-reflective layer; an opaque layer; a red-sensitive silver halide emulsion layer having a cyan dye-providing material associated therewith; a green-sensitive silver halide emulsion layer having a magenta dye-providing material associated therewith; and a blue-sensitive silver halide emulsion having a yellow dye-providing material associated therewith;

(2) a cover sheet superposed over said blue-sensitive silver halide emulsion layer and comprising a transparent support having thereon a neutralizing layer and a timing layer;

(3) a rupturable pouch containing an alkaline processing composition; and (4) a mask between said photosensitive element and said cover sheet, said mask providing an aperture adapted to receive said alkaline processing composition and a border which defines said image area of said photosensitive element, said mask being permanently bonded to said photosensitive element by a high strength adhesive composition which is disposed within said border and is subject to contact with said alkaline processing composition, said adhesive composition comprising: a polymeric acidic component adapted to neutralize said alkaline processing composition in said border and having at least 3 milliequivalents of acid per gram of said component, and a substantially immobile, blocked photographic development restrainer or a substantially immobile, blocked competing photographic developer.

* * * * *